US006340017B1

(12) United States Patent
Dick

(10) Patent No.: US 6,340,017 B1
(45) Date of Patent: Jan. 22, 2002

(54) FUEL INJECTOR

(75) Inventor: Malcolm David Dick, Lambert (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/637,944

(22) Filed: Aug. 11, 2000

(30) Foreign Application Priority Data

Aug. 18, 1999 (GB) ..... 9919424

(51) Int. Cl.[7] ..... F02M 37/04; F02M 59/00
(52) U.S. Cl. ..... 123/467; 239/533.7; 239/533.11
(58) Field of Search ..... 239/533.7, 533.11, 239/584; 137/625.38, 625.34; 251/325, 210, 175; 123/467

(56) References Cited

U.S. PATENT DOCUMENTS 5,522,550 A * 6/1996 Potz et al. ..... 239/533.9
5,758,829 A * 6/1998 Itoh et al. ..... 239/533.2
6,042,028 A * 3/2000 Xu ..... 239/585.1
6,113,011 A * 9/2000 Potz et al. ..... 239/533.2
6,155,499 A * 12/2000 Rembold et al. ..... 239/533.12
6,170,757 B1 * 1/2001 Herrmann et al. ..... 239/88
6,224,001 B1 * 5/2001 Cooke et al. ..... 239/533.12
6,270,024 B1 * 8/2001 Popp ..... 239/584

* cited by examiner

*Primary Examiner*—Thomas N. Moulis
(74) *Attorney, Agent, or Firm*—John Van Ophem

(57) ABSTRACT

An outwardly opening fuel injector comprises a valve needle movable within a bore provided in a nozzle body and engageable with a seating to control the supply of fuel from the bore. The valve needle is biased towards its seating and is moveable outwardly of the bore to move the valve needle away from its seating. The fuel injector comprises a sleeve member which is moveable with the valve needle, the valve needle and the sleeve member together defining a chamber for fuel such that, in use, fuel pressure within the chamber serves to dilate the sleeve member to reduce fuel leakage from the injector. A surface associated with the valve needle may be engageable with an additional seating defined by the bore to limit outward movement of the valve needle within the bore.

11 Claims, 5 Drawing Sheets

FUEL INJECTOR

TECHNICAL FIELD

This invention relates to a fuel injector for use in supplying fuel to a combustion space of a compression ignition internal combustion engine. In particular, the invention relates to an injector of the outwardly opening type. Such an injector is suitable for use in, for example, a common rail type fuel system.

BACKGROUND OF THE INVENTION

A typical, known fuel injector of the outwardly opening type is shown in FIG. 1, and includes a valve needle 10 which is slidable within a bore 12, the valve needle 10 including a valve needle guide region 12*a*. The valve needle 10 is engageable with a seating 14, defined by a fuel injector nozzle body 16, to control the supply of fuel from the bore 12 to the cylinder of an associated engine, fuel being delivered through first and second outlet openings occupying different axial positions on the valve needle 10. The valve needle 10 is biased against the seating 14 by means of a spring 18, and by means of fuel pressure, and is movable away from its seating 14 by means of a piezoelectric actuator arrangement, only part of which is shown, which includes a piezoelectric stack which is arranged to control fuel pressure within a control chamber, defined, in part by a bore 22 provided in an upper housing part. A surface associated with the valve needle 10 is exposed to fuel pressure within the control chamber, an increase in fuel pressure within the control chamber causing the valve needle 10 to move outwardly within the bore 12 away from the seating 14, against the force of the spring 18 and the fuel pressure, and thereby permitting fuel within the bore 12 to flow into the engine cylinder through the one or more of the outlet openings depending on the extent of movement of the valve needle 10 away from the seating 14.

A problem with fuel injectors of this type is that, as the valve needle 10 moves away from its seating 14, fuel within the bore 12 is able to leak past the valve needle guide region 12*a* into the engine cylinder. This leads to a poor fuel spray characteristic which can result in an inefficient combustion of fuel and high levels of emissions. In addition, as the bore 12 is prone to dilate due to the high pressure of fuel within the bore, the level of fuel leakage from the bore can increase during the service life of the injector.

SUMMARY OF THE INVENTION

It is an object of the present invention to provide a fuel injector of the outwardly opening type which alleviates the aforementioned problems.

According to the present invention there is provided an outwardly opening fuel injector comprising a valve needle movable within a bore provided in a nozzle body and engageable with a seating to control the supply of fuel from the bore, the valve needle being biased towards its seating and being moveable outwardly of the bore to move the valve needle away from its seating, the fuel injector further comprising a sleeve member which is moveable with the valve needle, the valve needle and the sleeve member together defining a chamber for fuel such that, in use, fuel pressure within the chamber serves to dilate the sleeve member to reduce fuel leakage from the injector.

As the sleeve member dilates due to fuel pressure within the chamber, the seal between the nozzle body and the sleeve member is improved and fuel leakage from the bore is reduced or prevented.

The chamber may be supplied with fuel by a clearance passage which may be defined, at least in part, by formations, for example flats, slots, grooves or flutes, provided on the surface of the valve needle.

Conveniently, the sleeve member may be provided with first and second outlet openings occupying different axial positions on the sleeve member. In use, movement of the valve needle away from the seating into a first fuel injecting position may cause the first outlet opening to be exposed to permit fuel delivery through the first outlet opening, and movement of the valve needle away from the seating into a second fuel injecting position may cause the second outlet opening to be exposed to permit fuel delivery from both outlet openings.

First and second sets of outlet openings may be provided, each set including one or more outlet opening. The first and second outlet openings may be of different size or may provide a different fuel spray cone angle to permit the fuel injection characteristic to be varied, in use.

The sleeve member may be engageable with a further seating defined by the nozzle body, movement of the valve needle into the second fuel injecting position causing the sleeve member to engage the further seating. Thus, when the valve needle is moved away from its seating into the second fuel injecting position, fuel is unable to flow past the further seating. In this way, the seal between the nozzle body and the sleeve member is further improved and fuel leakage from the injector is further reduced.

Preferably, a surface associated with the valve needle is engageable with an additional seating defined by the bore to limit outward movement of the valve needle within the bore.

The surface associated with the valve needle may preferably be defined by a step in the surface of the sleeve member. The additional seating may preferably be defined by a step in the surface of the bore.

According to a second aspect of the present invention, there is provided an outwardly opening fuel injector comprising a valve needle movable within a bore provided in a nozzle body and engageable with a seating to control the supply of fuel from the bore, the valve needle being biased towards its seating and being moveable outwardly of the bore to move the valve needle away from its seating, a surface associated with the valve needle being engageable with an additional seating defined by the bore to limit outward movement of the valve needle within the bore.

Conveniently, the fuel injector may include a sleeve member which is movable with the valve needle, the sleeve member defining the surface which is engageable with the further seating.

BRIEF DESCRIPTION OF THE DRAWINGS

The invention will further be described, by way of example, with reference to the accompanying drawings, in which.

DESCRIPTION OF THE PREFERRED EMBODIMENT

Figure 1:
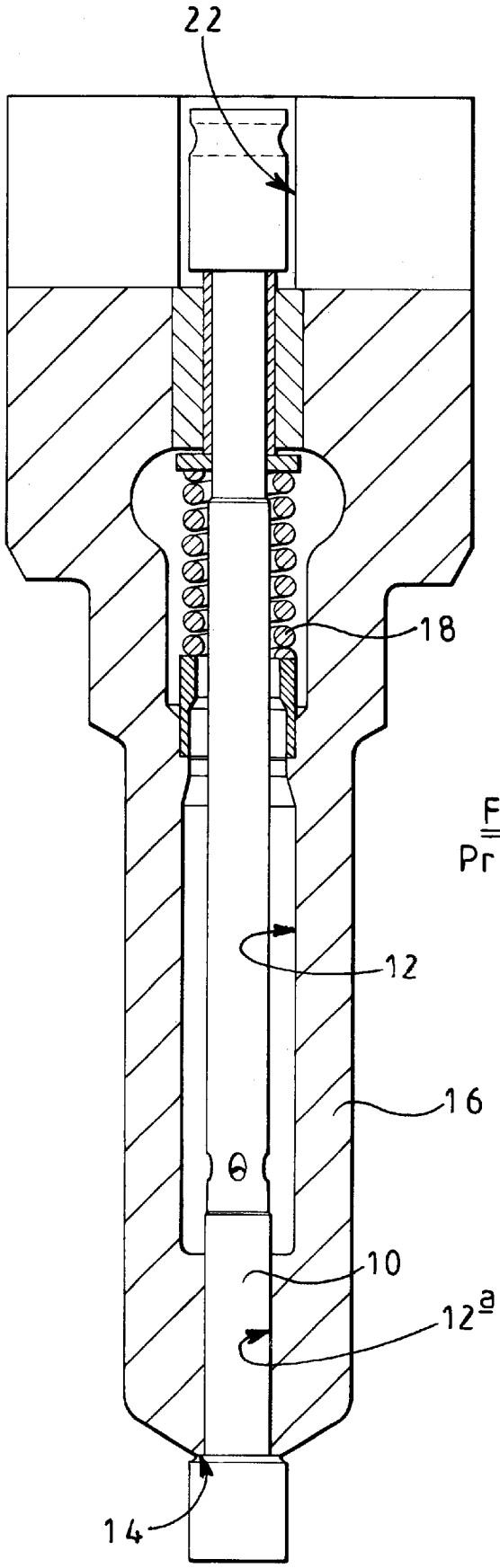
FIG 1 Prior art
FIG. 1 is a sectional view illustrating a typical, known fuel injector of the outwardly opening type.
Figure 2:
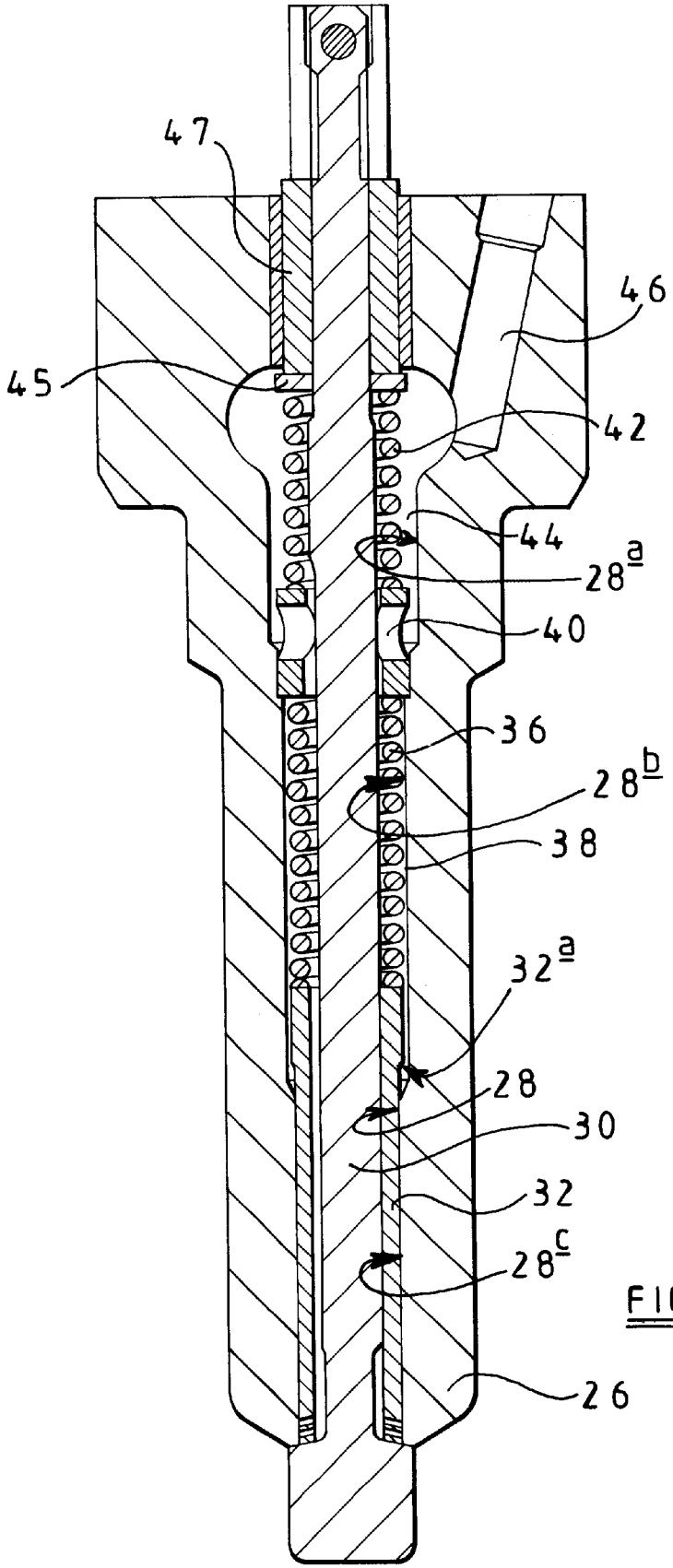
FIG. 2 is a sectional view of an embodiment of a fuel injector in accordance with the present invention.
Figure 3:
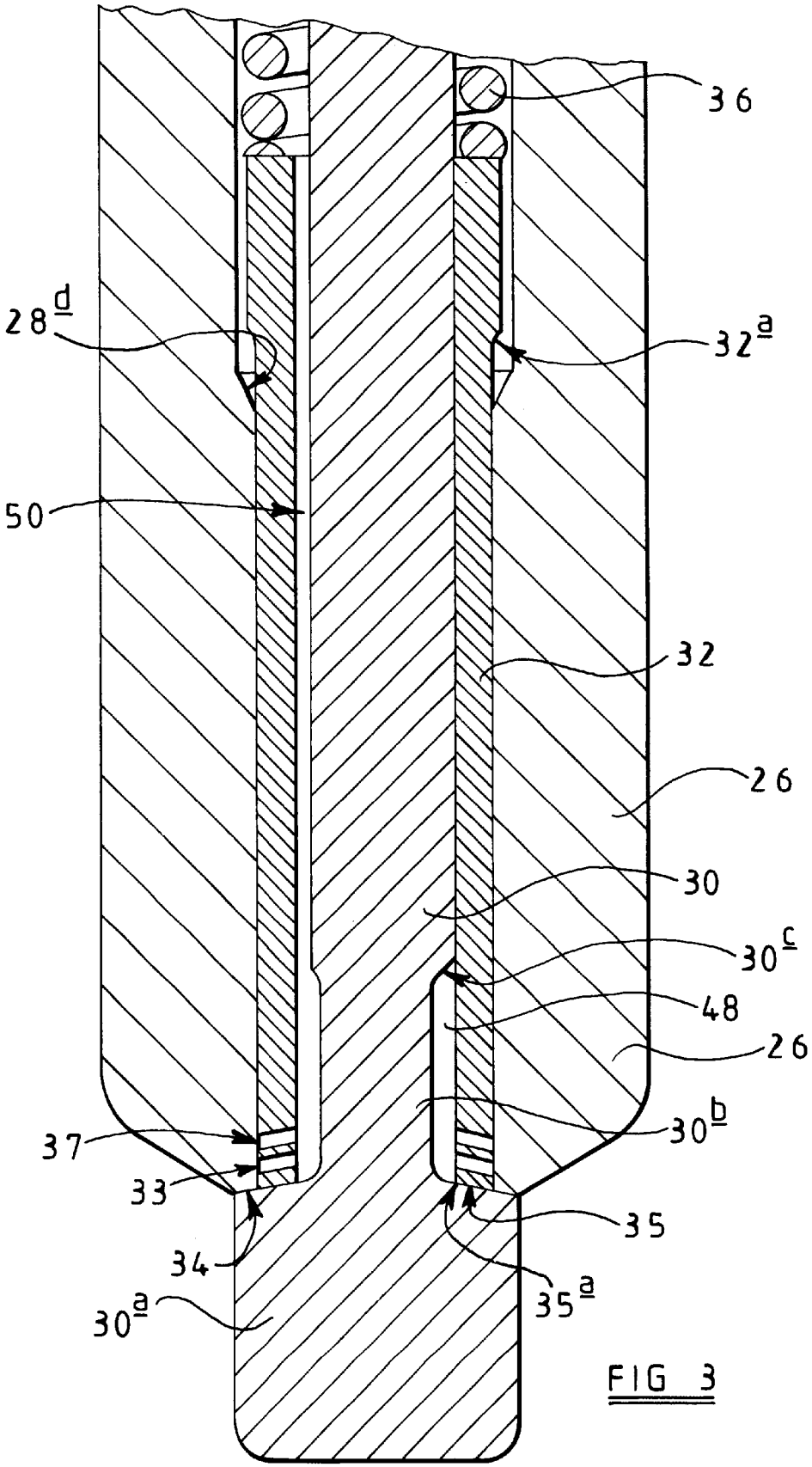
FIG. 3 is an enlarged view of a part of the fuel injector shown in FIG. 2.

Referring to FIGS. 2 and 3, the fuel injector of the present invention includes a nozzle body 26 which is provided with a through bore 28 within which a valve needle 30 is slidable. The bore 28 includes an enlarged diameter region 28*a*, an intermediate region 28*b* of reduced diameter and a lower region 28*c* of further reduced diameter, the bore defining a step 28*d* between the intermediate region 28*b* and the lower region 28*c*. A sleeve member 32 is received within the bore 28, the outer surface of the sleeve member 32 being of stepped form and defining a step 32*a* which is engageable with the step 28*d* defined by the bore 28. The valve needle 30 extends through the sleeve member 32, the valve needle 30 including an end region 30*a* of enlarged diameter which projects through the lower open end of the through bore 28 and the sleeve member 32 and which is engageable with a seating 34 defined by the nozzle body 26. The valve needle 30 also includes a region of reduced diameter 30*b* which defines, together with the inner surface of the sleeve member 32, a delivery chamber 48 for fuel.

The sleeve member 32 is biased by means of a compression spring 36 and fuel pressure towards a position in which part of the lower surface 35 of the sleeve member 32 engages the enlarged end region 30*a* of the valve needle 30 forming a seal at a seating 35*a*, the compression spring 36 being housed within a spring chamber 38 defined by the intermediate region 28*b* of the bore 28. The sleeve member 32 is provided with first and second sets of outlet openings 33, 37 respectively, one end of each outlet opening 33, 37 communicating with the delivery chamber 48 such that movement of the valve needle 30 away from the seating 34 permits fuel to flow from the delivery chamber 48 out through the first set of outlet openings 33, or through both sets of outlet openings 33, 37, depending on the extent of movement of the valve needle 30 away from the seating 34.

The end of the spring 36 remote from the sleeve member 32 abuts a first abutment member 40, the abutment member 40 engaging, at its end remote from the spring 36, a second compression spring 42 which is housed within a spring chamber 44 defined by the enlarged diameter region 28*a* of the bore 28. The end of the compression spring 42 remote from the first abutment member 40 is in abutment with a second abutment member 46 which abuts or is connected to a guide member 47 associated with the valve needle 30, the guide member 47 serving to guide sliding movement of the valve needle 30 within the bore 28. The abutment member 40 is secured to the valve needle 30, the spring force due to the spring 42 acting on the abutment member 40 and thereby serving to bias the valve needle 30 into a position in which the enlarged end region 30*a* of the valve needle 30 engages the seating 34 defined by the nozzle body 26. The compression spring 36 is pre-loaded with a lower load than the pre-load of the compression spring 42.

In use, fuel is supplied to the chamber 44 through a supply passage 46 provided in the end of the nozzle body 26 remote from the seating 34, the supply passage 46 communicating with a source of fuel at high pressure such as, for example, a common rail of a common rail fuel system, to permit fuel to be delivered to the chamber 44. Fuel within the chamber 44 is able to flow to the spring chamber 38 via flats, slots or grooves machined on the surface of the valve needle 30. Fuel delivered to the spring chamber 38 is able to flow to the delivery chamber 48 by means of a narrow clearance passage 50 which is defined between the inner surface of the sleeve member 32 and flats, slots or grooves provided on the surface of the valve needle 30. The effective areas of the valve needle 30 exposed to fuel pressure within the bore 28 are chosen to ensure that, in use, with fuel under high pressure delivered to the bore 28, the valve needle 30 is urged against the seating 34 by the fuel pressure and the spring 42 to prevent fuel delivery into the engine cylinder or other combustion space.

In use, movement of the valve needle 30 away from the seating 34 is controlled in a conventional way, for example by means of a piezoelectric actuator arrangement (not shown). A surface associated with the valve needle 30 may be exposed to fuel pressure within a control chamber, fuel pressure within the control chamber being controlled by varying the energisation level, and hence the axial length, of a piezoelectric stack. Alternatively, valve needle movement may be controlled directly by varying the axial length of the piezoelectric stack. In a further alternative embodiment, movement of the valve needle 30 may be controlled in a conventional way by means of an electromagnetic actuator arrangement.

In use, fuel under high pressure is supplied to the annular chamber 44 through the supply passage 46, fuel flowing into the spring chamber 38 and into the delivery chamber 48 via the clearance passage 50. The surface 35 of the sleeve member 32 is biased into sealing engagement with the enlarged end region 30*a* by means of the spring 36 and by fuel pressure and a seal is maintained at the seating 35*a*. The first and second sets of outlet openings 33, 37 remain covered by the nozzle body 26 and fuel is unable to flow out through the outlet openings into the engine cylinder.

Figure 4:
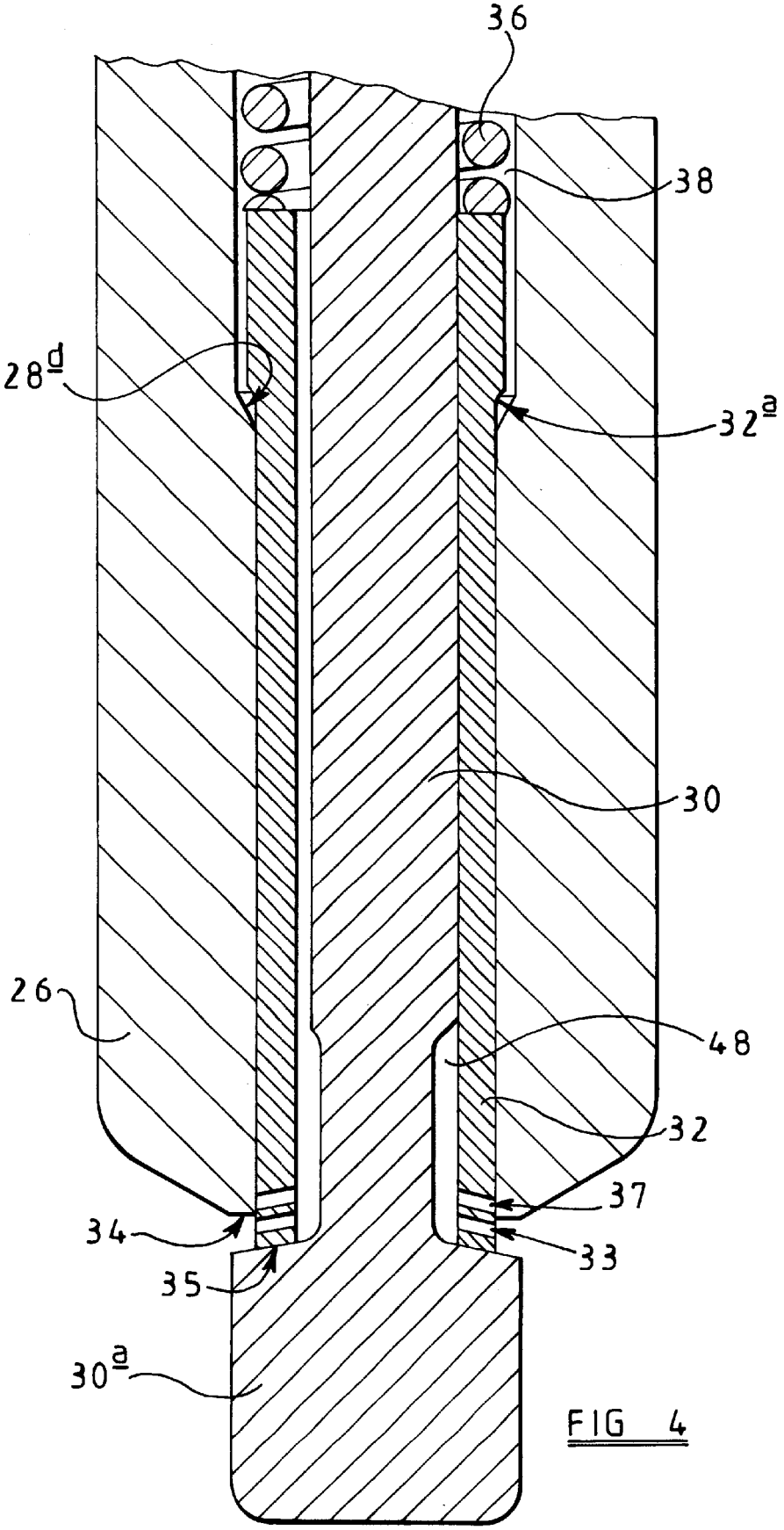
FIGS. 4 and 5 shown the fuel injector in FIGS. 2 and 3 in first and second fuel injecting positions respectively.

When injection is to be commenced, the piezoelectric actuator is energised such that fuel pressure within the control chamber acting on a surface associated with the valve needle 30 provides a downwards force on the valve needle 30 which is sufficient to overcome the force due to fuel pressure within the bore 28. Thus, the valve needle 30 is moved outwardly, the enlarged end region 30*a* moving away from the seating 34 to expose the first set of outlet openings 33, as shown in FIG. 4, the force due to the spring 36 and fuel pressure maintaining the seal at the seating 35*a*. Thus, during this stage of operation, fuel within the delivery chamber 48 is able to flow out through the first set of outlet openings 33 into the engine cylinder. Additionally, fuel pressure within the delivery chamber 48 acts on the sleeve member 32 in a radially outward direction, thereby serving to dilate the sleeve member 32 and improve the seal between the sleeve member 32 and the bore region 28*a*, fuel within the spring chamber 38 therefore being unable to escape from the fuel injector between the nozzle body 26 and the sleeve member 32.

In order to terminate injection, the piezoelectric actuator arrangement is de-energised from the first energisation level, causing fuel pressure within the control chamber acting on the surface associated with the valve needle 30 to be reduced. The valve needle 30 therefore moves inwardly due to fuel pressure within the bore 28 until the enlarged end region 30*a* of the valve needle 30 engages the seating 34 defined by the nozzle body 26. Fuel is therefore unable to flow out through the first set of outlet openings 33 and fuel injection ceases.

Figure 5:
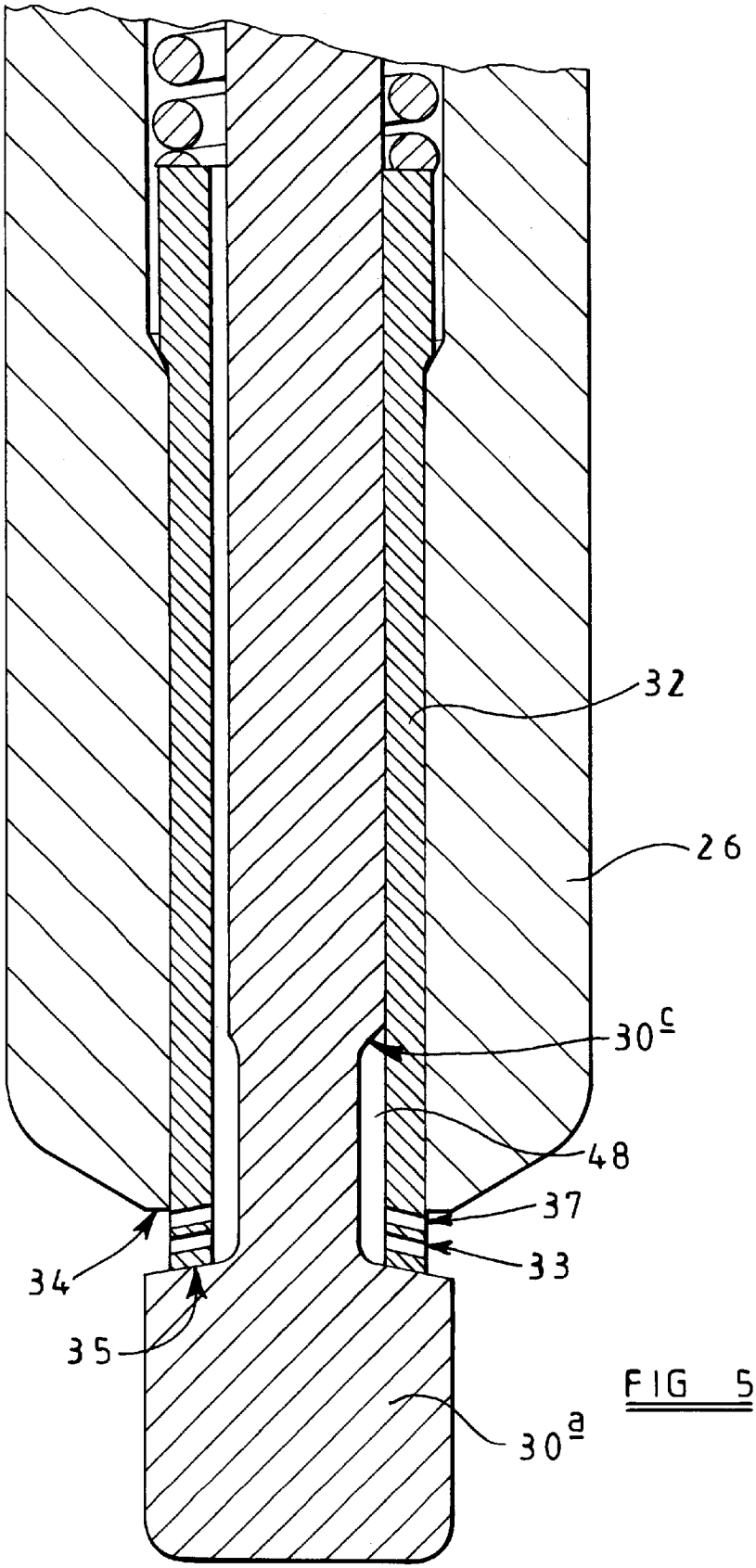

Alternatively, in order to increase the fuel injection rate, the piezoelectric actuator may be energised to a second, higher energisation level causing fuel pressure within the control chamber acting on the surface associated with the valve needle 30 to be further increased, the valve needle 30 thereby moving outwardly away from the seating 34 into a second fuel injecting position, as shown in FIG. 5, with both the first and second outlet openings 33, 37 exposed such that fuel within the delivery chamber 48 is delivered through both the first and second sets of outlet openings 33, 37. The extent of outward movement of the valve needle 30 away from the seating 34 is limited by engagement between the stepped surface 32*a* provided on the sleeve member 32 and the seating 28*d* defined by the bore 28, the stepped surface 32*a* provided on the sleeve member 32 engaging the seating 28*d* so as to form a substantially fluid-tight seal such that fuel within the spring chamber 38 is unable to flow past the seating 28*d*. The effect of the seal formed at the seating 28*d*, in addition to the effect of the dilation of the sleeve member 32, causes the seal between the nozzle body 26 and the sleeve member 32 to be further improved. Thus, during this stage of operation, fuel leakage between the nozzle body 26 and the sleeve member 32 is substantially eliminated.

In order to cease fuel injection the piezoelectric actuator is de-energised, causing fuel pressure within the control chamber acting on the surface associated with the valve needle 30 to be reduced, thereby causing the valve needle 30 to move inwardly until the enlarged end region 30*a* engages the seating 34, as shown in FIG. 3, causing fuel injection through the first and second sets of outlet openings 33, 37 to be terminated. Alternatively, if it is desired to inject fuel at a decreased rate, the piezoelectric actuator may be de-energised to the first energisation level, thereby causing the valve needle 30 to move inwardly to the position shown in FIG. 4 in which only the first set of outlet openings 33 are exposed.

The invention provides the advantage that, as the enlarged end region 30*a* of the valve needle is sealingly engageable with a seating defined by both the sleeve member 32 and the nozzle body 26, the seating can be manufactured more easily. Additionally, as the sleeve member 32 is a separate component, the first and second sets of outlet openings 33, 37 can also be manufactured relatively easily, prior to assembly of the fuel injector. The first and second sets of outlet openings 33, 37 provided in the sleeve member 32 can also be positioned in close proximity to the end face of the sleeve member 32 and, thus, the valve needle 30 need only be moved by a relatively small amount away from the seating 34 in order to commence injection.

In an alternative embodiment, the lower outlet opening 33, or set of outlet openings, may be provided by forming a recess or groove in the lower surface 35 of the sleeve member 32. By providing first and second sets of outlet openings 33, 37 having a different number of openings in each set, or having openings of different size, or having openings with a different fuel spray cone angle, it will be appreciated that by selectively injecting fuel from either the first set of outlet openings 33 alone, or from both the first and second sets of outlet openings 33, 37 together, by controlling the extent of movement of the valve needle 30 away from the seating 34, the fuel injection characteristics can be varied, in use. It will also be appreciated that a different number of outlet openings to those shown in the accompanying Figures may be provided in the sleeve member. A third or further set of outlet openings may be provided in the sleeve member, the actuator arrangement being arranged to control movement of the valve needle between first, second, third or further fuel injecting positions.

What is claimed is:

1. An outwardly opening fuel injector comprising a valve needle movable within a bore provided in a nozzle body and engageable with a seating to control the supply of fuel from the bore, the valve needle being biased towards its seating and being moveable outwardly of the bore to move the valve needle away from its seating, the fuel injector further comprising a sleeve member which is moveable with the valve needle, the valve needle and the sleeve member together defining a chamber for fuel such that, in use, fuel pressure within the chamber serves to dilate the sleeve member to reduce fuel leakage from the injector.

2. The fuel injector as claimed in claim 1, comprising a clearance passage defined, at least in part, by formations provided on the surface of the valve needle, whereby the chamber is supplied with fuel, in use, through the clearance passage.

3. The fuel injector as claimed in claim 1, wherein the sleeve member is provided with first and second outlet openings occupying different axial positions on the sleeve member, the injector being arranged such that, in use, movement of the valve needle away from the seating into a first fuel injecting position permits fuel delivery through the first outlet opening, and movement of the valve needle away from the seating into a second fuel injecting position permits fuel delivery through both the first and second outlet openings.

4. The fuel injector as claimed in claim 1, wherein first and second sets of outlet openings are provided, each set including one or more outlet opening.

5. The fuel injector as claimed in claim 3, wherein the sleeve member is in engagement with a further seating defined by the valve needle.

6. The fuel injector as claimed in claim 3, wherein a surface associated with the valve needle is engageable with an additional seating defined by the bore to limit outward movement of the valve needle within the bore.

7. The fuel injector as claimed in claim 6, wherein the surface associated with the valve needle is defined by a step in the surface of the sleeve member.

8. The fuel injector as claimed in claim 7, wherein the additional seating is defined by a step in the bore.

9. The fuel injector as claimed in claim 1, wherein movement of the valve needle is controlled, in use, by a piezoelectric actuator arrangement.

10. The fuel injector as claimed in claim 1, wherein the valve needle is provided with a guide member which serves to guide sliding movement of the valve needle within the bore.

11. An outwardly opening fuel injector comprising a valve needle movable within a bore provided in a nozzle body and engageable with a seating to control the supply of fuel from the bore, the valve needle being biased towards its seating and being moveable outwardly of the bore to move the valve needle away from its seating, a surface associated with the valve needle being engageable with an additional seating defined by the bore to limit outward movement of the valve needle within the bore.

* * * * *